US005579431A

United States Patent [19]

Reaves

[11] Patent Number: 5,579,431

[45] Date of Patent: Nov. 26, 1996

[54] SPEECH DETECTION IN PRESENCE OF NOISE BY DETERMINING VARIANCE OVER TIME OF FREQUENCY BAND LIMITED ENERGY

[75] Inventor: Benjamin K. Reaves, Yamatotakada, Japan

[73] Assignees: Panasonic Technologies, Inc., Secaucus, N.J.; Matsushita Electric Industrial Co. Ltd., Osaka, Japan

[21] Appl. No.: 956,614

[22] Filed: Oct. 5, 1992

[51] Int. Cl.[6] ..... G10L 9/00

[52] U.S. Cl. ..... 395/2.23; 395/2.24; 395/2.57; 395/2.62

[58] Field of Search ..... 395/2.19, 2.23, 395/2.24, 2.4, 2.42, 2.55–2.66; 381/46

[56] References Cited

U.S. PATENT DOCUMENTS

| | | | |
|---|---|---|---|
| 4,032,711 | 6/1977 | Sambur | 395/2.55 |
| 4,401,849 | 8/1983 | Ichikawa et al. | 395/2.19 |
| 4,815,136 | 3/1989 | Benvenuto | 395/2.26 |
| 4,817,159 | 3/1989 | Hoshimi et al. | 395/2.63 |
| 5,222,147 | 6/1993 | Koyama | 381/46 |
| 5,305,422 | 4/1994 | Junqua | 395/2.62 |
| 5,323,337 | 6/1994 | Wilson et al. | 395/2 |

OTHER PUBLICATIONS

Parsons, *Voice and Speech Processing,* McGraw–Hill, New York, NY, 1987, p. 21.

"A Robust Speech/Non–Speech Detection Algorithm Using Time and Frequency–Based Features," by Frank Mak et al., 1992 IEEE International Conference on Acoustics, Speech and Signal Processing, Mar. 23–26, 1992, v. 1, pp. 269–272.

*Primary Examiner*—Allen R. MacDonald
*Assistant Examiner*—Michael A. Sartori
*Attorney, Agent, or Firm*—Price, Gess & Ubell

[57] ABSTRACT

The device detects the beginning and ending portions of speech contained within an input signal based on the variance of frequency band limited energy within the signal. The use of the variance allows detection which is relatively independent of an absolute signal-to-noise ratio with the signal, and allows accurate detection within a wide variety of backgrounds such as music, motor noise, and background noise, such as other speakers. The device can be easily implemented using off-the-shelf hardware along with a high-speed special purpose digital signal processor integrated circuit.

17 Claims, 5 Drawing Sheets

202
nf
203
HAMMING WINDOW
FOURIER TRANSFORM
dB
SUM
103
204
205
206
207
208
209
nv
VARIANCE CALCULATION
210
211
105

SPEECH DETECTION IN PRESENCE OF NOISE BY DETERMINING VARIANCE OVER TIME OF FREQUENCY BAND LIMITED ENERGY

BACKGROUND OF THE INVENTION

1. Field of the Invention

The invention generally relates to a device for the detection of the start and end of a segment containing speech within an input audio signal which contains both speech segments and nonspeech noise or background segments.

2. Description of Related Art

Detection of speech in real time is a necessary component for many devices, including but not limited to voice-activated tape recorders, answering machines, automatic speech recognizers, and processors for removing speech from music. Many of these applications have noise inseparably mixed with the speech. Detection of speech requires a more sophisticated speech detection capability than provided by conventional devices that simply detect when energy levels rise above or fall below a preset threshold.

In the field of automatic speech recognition, the speech detection component is most critical. In practice, more speech recognition errors arise from errors in speech detection than from errors in pattern matching, which is commonly used to determine the content of the speech signal. One proposed solution is to use a word spotting technique, in which the recognizer is always listening for a particular word. However, if word spotting is not preceded by speech detection, the overall error rate can be high.

Many speech detection devices are based on a certain parameter of the input, such as energy, pitch, and zero crossings. The performance of the speech detector depends heavily on the robustness of that parameter to background noise. For real time speech detection, these parameters must be quickly extracted from the signal.

OBJECTS AND SUMMARY OF THE INVENTION

One of the objects of the present invention is to provide a device for the detection of speech which is capable of operation at a speed fast enough to keep up with the arrival of the input, i.e., real time.

Another object of the present invention is to provide a device for the detection of speech that can be implemented with a conventional digital signal processing circuit board.

Another object of the present invention is to provide a device for the detection of speech which is effective despite various types of noise mixed with the speech.

Another object of the present invention is to provide a speech detection device for various applications, including, but not limited to: isolated word automatic speech recognizers, continuous speech recognizers (to detect pauses between phrases or sentences), voice-controlled tape recorders, answering machines, and the processing of voice embedded in a recording with background noise or music.

These and other objects of the invention are achieved by the provision of a device for detecting speech in an input signal which includes means for determining a value representative of frequency band limited energy within the signal, means for determining a variance of the value representative of the frequency band limited energy of the signal, and means for determining the beginning and ending points of speech within the signal based on the variance of the band limited energy.

The invention exploits the variance in frequency band limited energy to detect the beginning and end of speech within an input speech signal. Variance of the frequency band limited energy is employed based on the observation that for foreground speech occurring in a difficult background, such as a lead vocalist against a background of music, there is a noticeable fluctuation of the energy level above a "noise floor" of relatively low fluctuation. This effect occurs although the level of the foreground and the level of the background may be high. Variance quantifies that fluctuation of energy.

In accordance with the preferred embodiment, the device calculates frequency band limited energy using a Hamming window and a Fourier transform. The variance is calculated as a function of time from frequency band limited energy values stored in a shift register. To determine the beginning and ending points of speech within an input signal, the device compares the variance as a function of time with two predetermined threshold levels, an upper threshold level and a lower threshold level. If the variance exceeds the lower threshold level, the device tentatively determines that speech has begun. However, if the variance does not subsequently rise above the upper threshold level before falling below the lower threshold level, then the tentative determination of the beginning of speech is discarded. When the variance is between the lower and upper threshold levels, the device characterizes the signal as being in a beginning (B) :speech state. Once the variance exceeds the upper threshold level, the device characterizes the signal as being within a speech (S) state. If the variance does not remain within speech state(s) for at least a predetermined period of time, such as 0.3 seconds, the speech is rejected as being too short. If the variance remains above the upper threshold level for at least the predetermined period of time, then the determination of the beginning point of the speech is retained. Finally, the ending point of the speech is determined when the variance falls below the lower threshold level.

By employing upper and lower threshold levels and by testing whether the variance remains within the speech state for at least a predetermined period of time, the error rate in detecting speech is minimized.

Preferably, the device is implemented within integrated circuit hardware such that the processing of the input signal to determine the beginning and ending points of speech based on the variance of the frequency band limited energy can be performed in real time.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a speech detection device which detects the beginning and ending points of speech based on the variance of the frequency band limited energy of an input signal.

Figure 1:
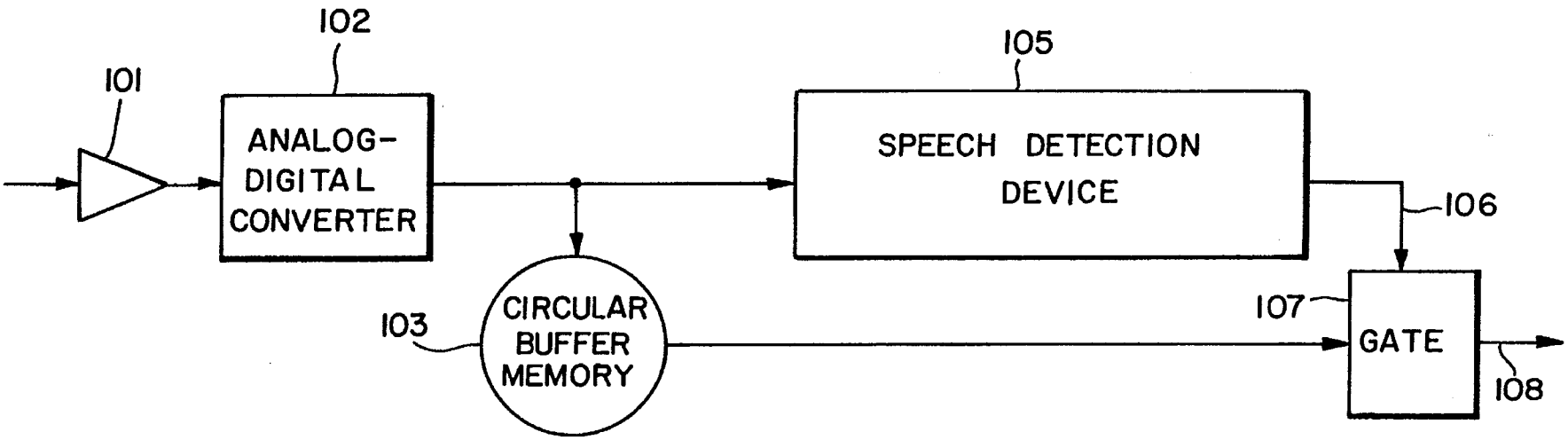
FIG. 1 provides a block diagram of an automatic speech recognizer, employing a speech detection device in accordance with a preferred embodiment of the invention.

A preprocessor for an isolated word automatic speech recognition system using the present invention is illustrated in FIG. 1. Analog input 101, from a microphone, is voltage-amplified and converted to digital form by an analog-to-digital converter 102 at a rate equal to a sampling frequency (typically 10,000 samples per second). A resulting digital signal 103 is saved in a memory area 104 that can store up to m seconds of speech where m is between 0.1 and 10 seconds. In the preferred embodiment m is 6.5536 seconds—a period longer than any single word utterance. If the capacity of 104 is exceeded, then old data is erased as new data is saved. Thus, memory 104 contains the most recent 6.5536 seconds of input data. The digital signal 103 also serves as input to a speech detection device 105. An output decision signal 106 triggers a gate 107 to pass a portion of memory 104 which has been determined by 105 to contain speech, to an output 108. For different applications, the length of buffer memory 104 can be modified and, in some applications such as an answering machine, buffer memory 104 can be eliminated, and signal 106 can control a tape drive directly.

Figure 2:
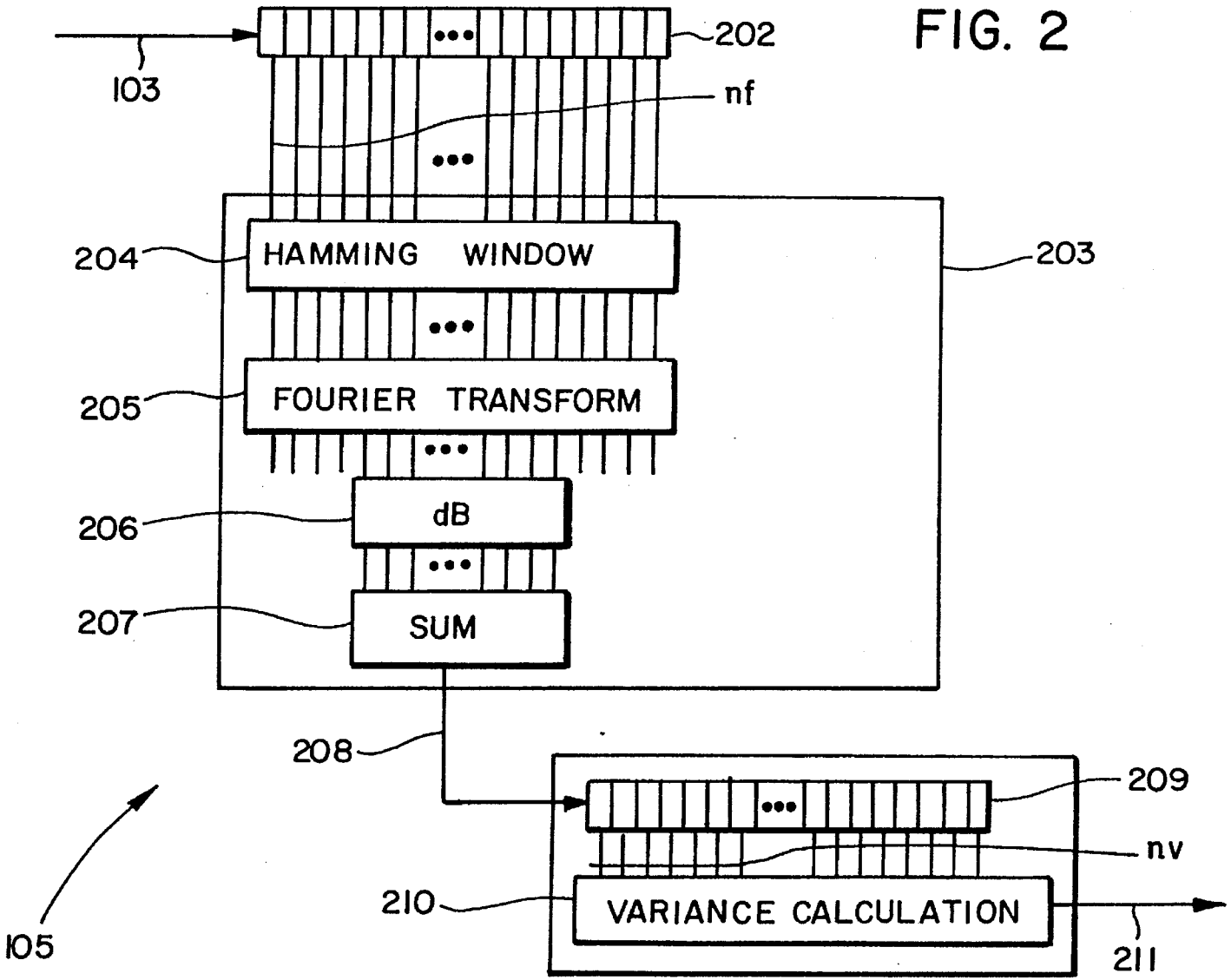
FIG. 2 is a block diagram of the speech detection device of FIG. 1.
Figure 3:
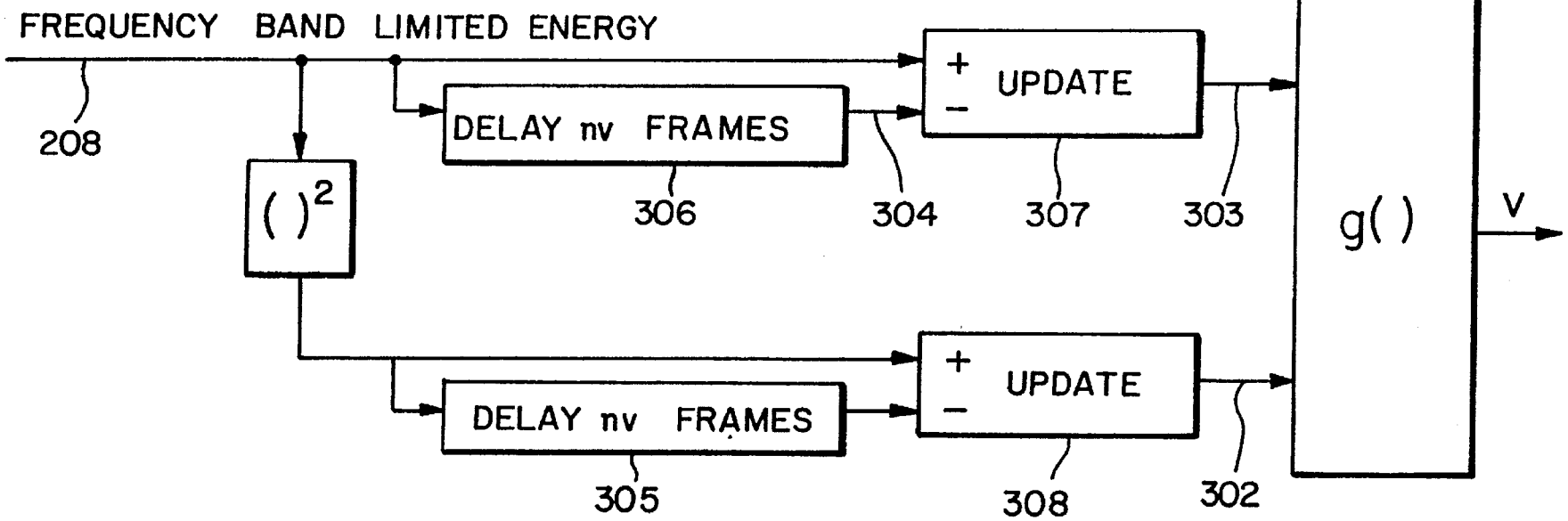
FIG. 3 provides a flow chart illustrating a method for initially determining the variance of the frequency band limited energy employed by the speech detection device of FIG. 2.
Figure 4:
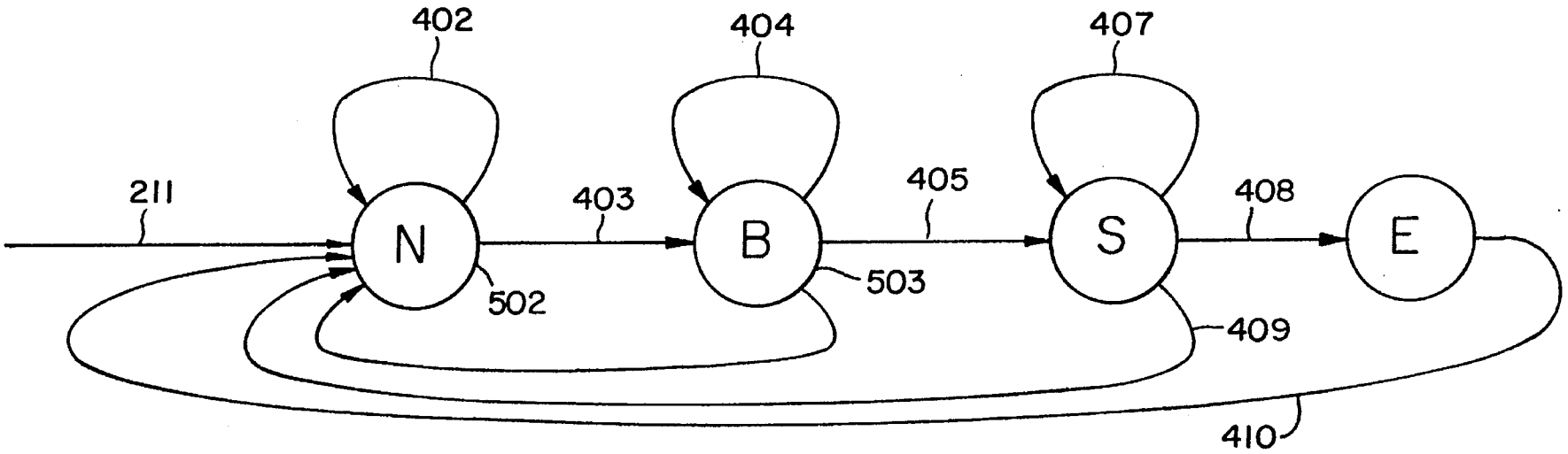
FIG. 4 is a state diagram illustrating the speech detection device of FIG. 2.

Speech detection device 105 is illustrated in detail in FIGS. 2, 3, and 4. The digital input signal 103 of FIG. 1 is shown as input signal 103 of FIG. 2. Signal 103 enters a delay line shift register 202 keeps nf consecutive samples of the input (e.g. 256). When register 202 is filled, a frequency band limiter CO3 starts processing the signal. When nf/2 (e.g. 128) new samples of input data 103 have been received, a delay line shift register 202 shifts 128 to the right, erasing the 128 oldest samples, and fills the left half with 128 new samples. Thus, shift register 2O2 always contains 256 consecutive samples of the input and overlaps 50% with the previous contents. the unit of time for the 128 new samples to be ready is a frame, and one frame is, e.g., 0.0128 seconds.

The frequency band limited energy is calculated by frequency band limiter 203. After multifplying the elements of the delay line shift register 202 by a Hamming window 204, a Fourier transform, 205, extracts the frequency spectrum of the contents of shift register 202. The spectral components corresponding to frequencies between 250 Hz and 3500 Hz, the band that contains the most important speech information, are converted to units of decibels by dB converter unit 206, and are summed to together in summer unit 267 producing the frequency band limited energy on output line 208.

Alternatively, band limiting may be performed by a method other than summing the portions of a frequency spectrum converter. For example, the input signal 103 may be digitally filtered by convolution or by passing through a digital filter, which replaces shift register 202 and all of frequency band limiter 203 of FIG. 2. Then, the resulting energy of the signal may be measured by a method described below.

Also, band limiting may be performed in the analog domain, with the energy obtained directly from the band limiting filter, or by a method described below. The analog band limiter may consist of a band-pass filter, a low pass filter, or another spectral shaping filter, or may arise from frequency limiting inherent in an amplifier or microphone, or may take the form of an antialiasing filter. The energy may be obtained directly from the filter or by a method described in the following paragraph. The signal resulting from either of these alternative techniques is hereafter referred to as the frequency band limited signal.

Any quantity that varies generally monotonically with the energy of the frequency band limited signal is hereafter called the frequency band limited energy. Instead of the method described in FIG. 2, the frequency band limited energy may be calculated by: (a) calculating the variance of the frequency band limited signal over a short period of time; (b) summing the absolute value, magnitude, rectified value, or square or other even power of the frequency band limited signal over a short period of time; or (c) determining the peak of the value, the magnitude, the rectified value, or square or other power of the frequency band limited signal over a short period of time.

Continuing with the preferred embodiment of the invention, frequency band limited energy 208 enters a delay line shift register 209 which differs from delay line shift register 202 in that (a) it receives one (not 128) new entry every frame, and (b) it shifts right by one (not by 128) when each new entry arrives. The length of this delay line shift register 209 is nv, which corresponds to a pause length of, for example, 0.64 seconds, or 50 frames:

$$nv = \frac{(\text{pause length}) \times (\text{sampling frequency})}{(nf/2)}$$

Variance calculation unit 210 calculates the variance of the values in delay line shift register 209. The variance of the frequency band limited energy, is:

$$V = g(A, B)$$

$$g(A, B) = \frac{A}{nv} - \frac{(B \times B)}{(nv \times nv)}$$

and $$A = \sum_{f=1}^{nv} [BLE(f) \times BLE(f)]$$

and $$B = \sum_{f=1}^{nv} BLE(f)$$

and

V is the output 211 of the variance calculation 210;

and

BLE(f) is the contents of delay line shift register 209 at locations f=nv, . . . , 3, 2, 1; BLE (1) is the oldest BLE value; and BLE is the frequency band limited energy.

FIG. 3 shows a faster way to calculate the variance V, replacing the variance calculation unit 210 and delay line shift register 209. This preferred technique updates, rather than recalculates, quantities A and B as follows:

$$A'=A+[BLE(nv)\times BLE(nv)]-[BLE(0)\times BLE(0)]$$

$$B'=B+BLS(nv)-BLS(0)$$

where

A' is the updated value for A, shown as signal 302, and

B' is the updated value for B, shown as signal 303, and

BLE(nv) is the newest frequency band limited energy, 208 (FIG. 2), and

BLE(0) is the oldest frequency band limited energy signal 304.

The square of BLE is delayed in the delay line memory 305. This delay line memory can be removed and replaced by squaring the value from 304 in situations where memory is expensive but multiplication is inexpensive. The delay line memories 305 and 306 should be cleared to zero upon initialization. Also, note that the delay line memories 306 and 305 are one longer than delay line shift register 209 of FIG. 2.

Figure 5:
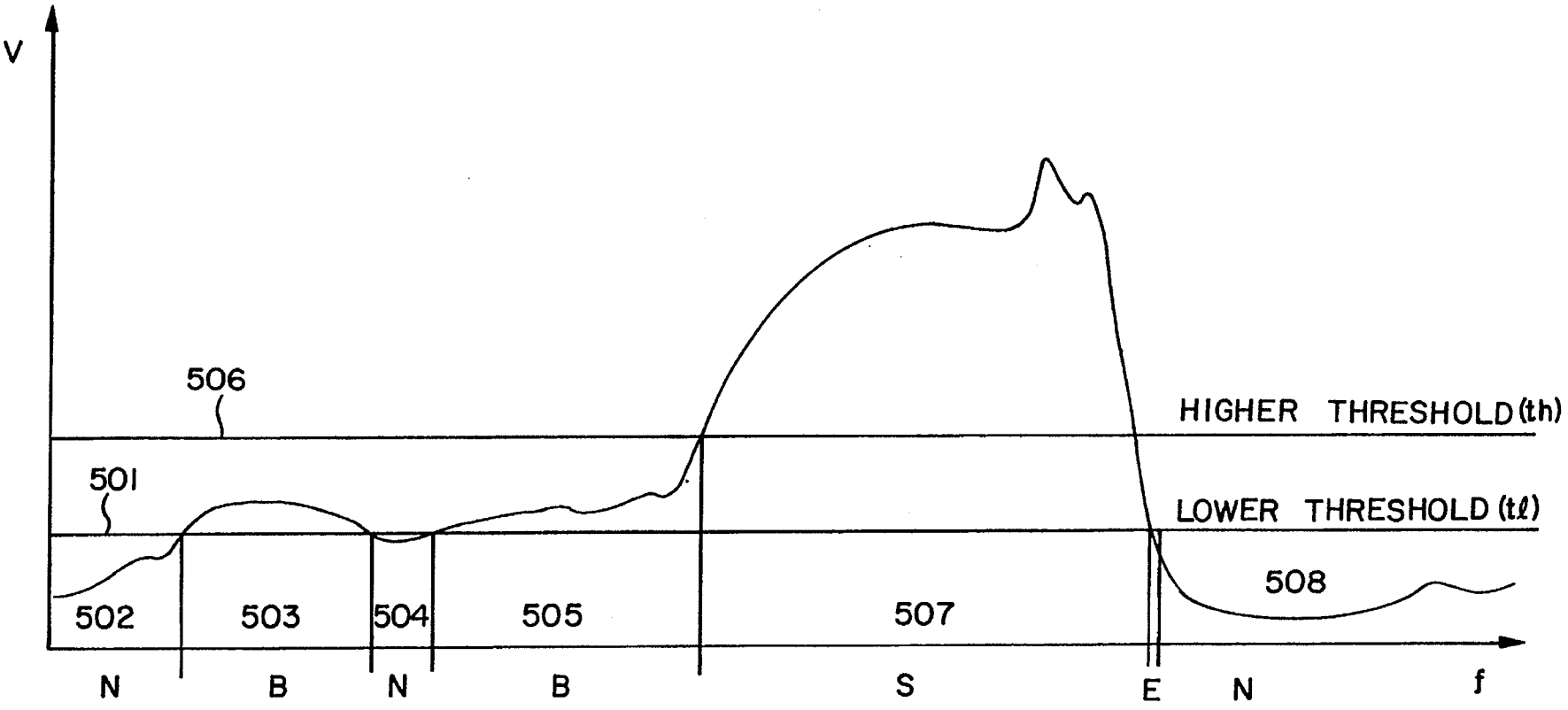
FIG. 5 is an exemplary input signal.

FIG. 4 shows a state diagram that describes how the variance 211 is used in detecting the existence of speech. FIG. 5 shows an example of a speech signal as an aid in understanding the state diagram.

The state diagram begins in the N or Noise state (502). As long as the variance V, which is from 211 of FIG. 2, stays below the lower threshold 501, transition 402 is taken, and state N is not exited. When V rises above threshold 501, transition 403 is taken, and state B (beginning of speech) is entered. One of three transitions can be taken from state B, depending on the conditions, as follows:

th<V: transition 405 (advance to S, speech)

t1<V<th: transition 404 (stay in B)

O<V<t1: transition 406 (rejected: go to N)

where th is the upper, high threshold 506 and t1 is 501 the low threshold.

Segments 502, 503, and 504 show how these transition conditions make the device wait for a sizable rise in variance before entering the S, or speech, state. The conditions and transitions for exiting the state S are:

| | | |
|---|---|---|
| $t1 < V$ | : | transition 407 (stay in $S$) |
| $V < t1$ and duration in $S > 0.3$ second | : | transition 408 |
| $V < t1$ and duration in $S < 0.3$ second | : | transition 409 |

The conditions for exiting state S depend on the low threshold t1, not th the high threshold 506, to avoid instabiity when V is near th. Transition 409 rejects utterances that are too short to be a single word. Segment 507 shows the usual case: staying in state S until the variance decreases below t1, taking transition 408 to state E.

State E triggers the output decision signal 106 of FIG. 1, showing that the end of the utterance has been found. Because the variance depends on the past nv (FIG. 3) frames, it will decrease about nv frames after the frequency band limited energy fluctuations decrease. After state E the state recycles to state N, to be ready for the next utterance.

Thresholds t1, 501, and th, 506 are determined early in a first N state, by examining the level of the variance there. They are set as follows:

th=3.0× average of variance of 10 frames of N state;

t1 =1.2× average of variance of 10 frames of N state.

What has been described is a device for detecting the presence of speech within an input signal. The device calculates the beginning and the ending points of speech based on the variance of the frequency band limited energy within the signal. By utilizing the variance of the frequency band limited energy, the presence of speech is effectively detected in real time. The device is particularly useful for detecting a segment of a recording that contains speech, such that the segment can be extracted and further processed.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A device for detecting speech in an input signal comprising:

first determining means for determining a plurality of values representative of a plurality of frequency band limited energy within the signal, wherein the signal is sampled at a predetermined sampling rate in a single frequency band over a first plurality of frames, wherein each frame comprises a plurality of samples;

second determining means for receiving the plurality of values from said first determining means, and determining a variance of the frequency band limited energy of the signal the single frequency band over a second plurality of frames; and third determining means for determining beginning and ending points of speech within the signal using the variance of the frequency band limited energy, wherein the third determining means comprises:

fourth determining means for determining a beginning of speech as occurring when the variance of the frequency band limited energy exceeds an upper threshold level and for determining an ending of speech as occurring when the variance of the frequency band limited energy falls below a lower threshold level, the upper threshold level being greater than the lower threshold level.

2. The device of claim 1, wherein the first determining means comprises:

fifth determining means for determining frequencies associated with the signal;

selecting means for selecting portions of the signal having frequencies within a preselected range; and sixth determining means for determining a total energy within the selected portions of the signal, the total energy being the frequency band limited energy.

3. The device of claim 1, wherein the first determining means comprises:

first applying means for applying a Hamming window filter to a portion of the signal to generate a filtered signal;

second applying means for applying a Fourier Transform to the filtered signal to generate a transformed signal; and summing means for summing the transformed signal to generate a value representative of total energy in the portion of the signal, the value representative of the total energy being the frequency band limited energy.

4. The device of claim 1, wherein the device includes:

receiving means for receiving the signal;

storing means for storing a portion of the signal covering a continuous period of m seconds where m is between 0.1 and 10 seconds; and updating means for updating the stored portion of the signal as new signals are received, wherein the first determining means determines the value representative of the frequency band limited energy from the stored portion of the signal, the value representative of the frequency band limited energy being updated as new signals are received.

5. The device of claim 4, wherein the storing means comprises a shift register.

6. The device of claim 1, wherein the second determining means comprises:

first calculating means for calculating variance, V, wherein V is given by V=g(A,B); where $$g(A, B) = \frac{A}{nv} - \frac{(B \times B)}{(nv \times nv)};$$

$$A = \sum_{f=1}^{nv};$$

$$B = \sum_{f=1}^{nv} BLE(f);$$

BLE(f) represents the plurality of values representative of the frequency band limited energy, nv is a number of values of the frequency band limited energy, f=nv, . . . , 3, 2, 1; and BLE(1) is an oldest BLE value.

7. The device of claim 6, wherein the second determining means further comprises:

second calculating means for calculating V=g(A', B') as new values of BLE(nv) are received, where $$A' = A + [BLE(nv) \times BLE(nv)] - [BLE(0) \times BLE(0)];$$

$$B' = B + BLE(nv) - BLE(0);$$

where

A' is an updated value for A, and

B' is an updated value for B, and

BLE(nv) is a newest frequency band limited energy, and

BLE(1) is the oldest frequency band limited energy.

8. The device of claim 1, wherein upper and lower threshold levels are predetermined, and wherein the beginning (B) of speech is determined at a point in time when the variance initially exceeds the lower threshold level, and the variance subsequently remains above the lower threshold level until the variance also exceeds the upper threshold level.

9. The device of claim 1, wherein the upper and lower threshold levels are predetermined, and wherein the ending of the signal is determined as a point in time when the variance falls below the lower threshold level.

10. The device of claim 9, wherein the determination of the beginning and ending points of the signal is rejected if the signal does not remain above the upper threshold level for a predetermined time period.

11. The device of claim 10, wherein the predetermined time period is 0.3 seconds.

12. In a device for recognizing speech within an input signal, with the device having means for receiving the signal, means for determining beginning and ending points of speech within the signal, and means for determining content of speech within the signal between the beginning and ending points, an improvement to the means for determining the beginning and ending points of the speech comprising:

first determining means for determining a plurality of values representative of a plurality of frequency band limited energy within the signal, wherein the signal is sampled at a predetermined sampling rate in a single frequency band over a first plurality of frames, wherein each frame comprises a plurality of samples;

second determining means for receiving the plurality of values from said first determining means, and determining a variance of the frequency band limited energy of the signal in the single frequency band over a second plurality of frames; and third determining means for determining beginning and ending points of speech within the signal based on the variance of the frequency band limited energy, wherein the third determining means comprises:

fourth determining means for determining a beginning of speech as occurring when the variance of the frequency band limited energy exceeds an upper threshold level and for determining an ending of speech as occurring when the variance of the frequency band limited energy falls below a lower threshold level, the upper threshold level being greater than the lower threshold level.

13. A device for the detection of speech in an input signal, comprising:

first determining means for determining a variance of a frequency band limited energy of the signal; and speech interval decision means for deciding start and end points of speech within the signal based on said variance, wherein said speech interval decision means comprises:

second determining means for determining a beginning of speech as occurring when the variance of the frequency band limited energy exceeds an upper threshold level and for determining an ending of speech as occurring when the variance of the frequency band limited energy falls below a lower threshold level, the upper threshold level being greater than the lower threshold level, wherein the first determining means for determining a variance comprises:

third means for providing a plurality of determined values representative of a plurality of frequency band limited energy at a predetermined sampling rate in a single frequency band over a first plurality of frames, wherein each frame comprises a plurality of samples; and fourth means for calculating the variance from the plurality of determined values provided from the third means in the single frequency band over a second plurality of frames.

14. The device of claim 13, wherein the frequency band limited energy is derived from routing the signal through a Fourier transform.

15. The device of claim 13, wherein said variance is determined from the frequency band limited energy over a continuous period of m seconds, where m is between 0.1 second and 10 seconds.

16. The device of claim 13, wherein the variance of the frequency band limited energy is determined by maintaining a sum of m seconds of frequency band limited energy, wherein m is between 0.1 to 10 seconds, and a sum of squares of said m seconds of frequency band limited energy and, for a new variance determination, the sum of squares of frequency band limited energy is updated by adding a square of a newest frequency band limited energy and subtracting a square of the frequency band limited energy value m seconds past, and wherein the sum of said m seconds of frequency band limited energy is updated by adding the newest frequency band limited energy and subtracting the frequency band limited energy value m seconds past.

17. A device for detecting speech in an input signal comprising:

first determining means for determining a plurality of values representative of a plurality of frequency band limited energy within the signal, wherein the signal is sampled at a predetermined sampling rate in a single frequency band over a first plurality of frames, wherein each frame comprises a plurality of samples, the first determining means using a frequency band limiter;

second determining means for receiving the plurality of values from said first determining means, and determining a variance of the frequency band limited energy of the signal in the single frequency band over a second plurality of frames; and third determining means for determining beginning and ending points of speech within the signal using the variance of the frequency band limited energy.

* * * * *